United States Patent [19]

Wang et al.

[11] 4,304,613

[45] Dec. 8, 1981

[54] TINI BASE ALLOY SHAPE MEMORY ENHANCEMENT THROUGH THERMAL AND MECHANICAL PROCESSING

[75] Inventors: Frederick E. Wang, Silver Spring, Md.; William J. Buehler, Sarasota, Fla.

[73] Assignee: The United States of America as represented by the Secretary of the Navy, Washington, D.C.

[21] Appl. No.: 149,051

[22] Filed: May 12, 1980

[51] Int. Cl.[3] ..... C22F 1/10

[52] U.S. Cl. ..... 148/11.5 N; 148/11.5 F; 148/32

[58] Field of Search ..... 148/11.5 N, 11.5 F, 148/32

[56] References Cited

U.S. PATENT DOCUMENTS

| | | | |
|---|---|---|---|
| 3,174,851 | 3/1965 | Buehler et al. | 75/170 |
| 3,403,238 | 9/1968 | Buehler et al. | 337/393 |
| 3,529,958 | 9/1970 | Buehler | 75/170 |
| 3,558,369 | 1/1971 | Wang et al. | 148/133 |
| 3,594,239 | 7/1971 | Wang | 148/13 |
| 3,652,969 | 3/1972 | Willson et al. | 337/140 |
| 3,748,197 | 7/1973 | Willson et al. | 148/131 |

*Primary Examiner*—R. Dean

*Attorney, Agent, or Firm*—R. S. Sciascia; A. L. Branning; R. D. Johnson

[57] ABSTRACT

A process for improving the shape change memory properties of a titanium-nickel base alloy by (1) heat treating the alloy to convert the TiNi phase to CsCl (B2)-type crystal structure, (2) cold working the alloy to increase the micro-twining, and finally (3) thermal cycling the alloy through the transition temperature range (TTR) while a load is applied in order to improve the orientation of the micro-twins.

24 Claims, 1 Drawing Figure

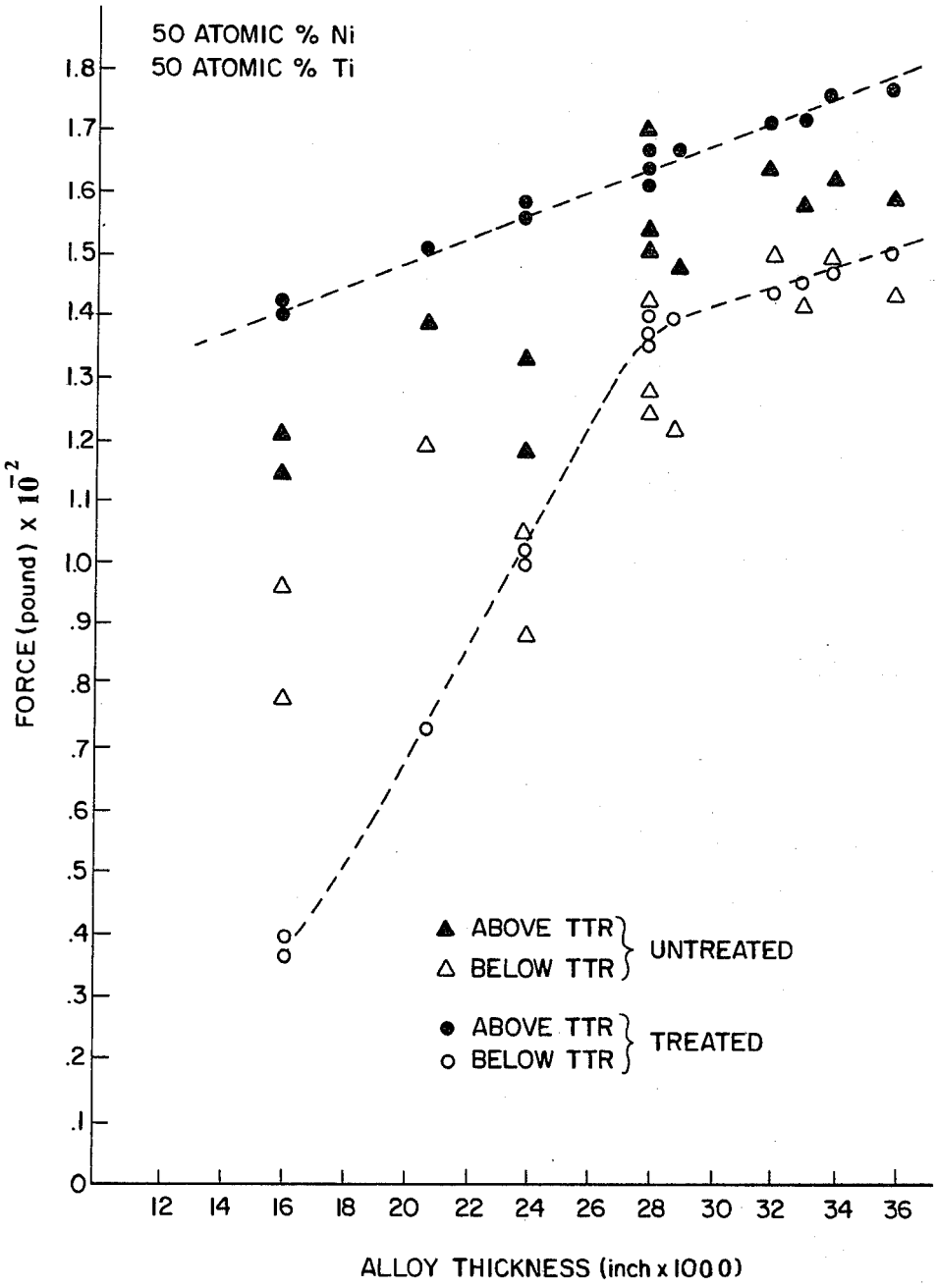
50 ATOMIC % Ni
50 ATOMIC % Ti
FORCE (pound) x 10^-2
1.8
1.7
1.6
1.5
1.4
1.3
1.2
1.1
1.0
.9
.8
.7
.6
.5
.4
.3
.2
.1
0
12
14
16
18
20
22
24
26
28
30
32
34
36
ALLOY THICKNESS (inch x 1000)
ABOVE TTR
BELOW TTR
UNTREATED
ABOVE TTR
BELOW TTR
TREATED

TINI BASE ALLOY SHAPE MEMORY ENHANCEMENT THROUGH THERMAL AND MECHANICAL PROCESSING

BACKGROUND OF THE INVENTION

This invention relates to metal alloys and more particularly to titanium-nickel based alloys having shape change memories.

Certain of the Nitinol (nickel-titanium based) alloys are noted for their shape memory recovery when they are heated through their critical recover-temperature range or transition temperature range (TTR) following plastic straining. The reproducibility of the shape change memory property is most severely tested in multiple cycling, where a given titanium-nickel base alloy specimen is strained plastically within the limits for "memory" recovery range (about 8% axial or outer fiber strain) followed by inducing shape recovery by heating the specimen through the transition temperature range (TTR).

Prior efforts to attain shape memory perfection have been attempted by others. For example, note U.S. Pat. No. 3,652,969, entitled "Method and Apparatus for Stabilizing and Employing Temperature Sensitive Materials Exhibiting Martensitic Transitions," which issued to J. Willson and D. Carey on Mar. 28, 1972. That patent only addresses micro-twinning and more specifically micro-twin orientation. While the maximization, refinement, and orientation of micro-twins is very important, these factor are not sufficient to provide the maximum magnitude and reproducibility of shape change.

SUMMARY OF THE INVENTION

Accordingly, it is an object of this invention to provide titanium-nickel base shape memory alloys with greater accuracy of shape recovery or dimensional change.

Another object of this invention is to provide titanium-nickel base shape memory alloys having constant shape memory effects upon multiple cycling through the shape transition temperature ranges.

Yet another object of this invention is to provide consistent and reliable reproducibility of shape memory effect in different titanium-nickel base alloys samples of the same composition and dimensions.

A further object of this invention is to increase the force-difference associated with the shape recovery of a titanium-nickel base shape memory alloy (between below and above the TTR).

These and other objects of this invention are accomplished by providing a process comprising the following steps in order:

(1) forming a favorable atomic-order in the alloy by (a) heating the alloy at a temperature above 700° C. but below the melting point of the alloy until the TiNi phase has crystallized into disordered body centered cubic (A2) structure;

(b) slowly cooling the alloy to a temperature in the range from 600° C. to about 700° C.; and (c) annealing the alloy in the temperature range of 600° C. to 700° C. until the TiNi phase has been substantially converted from disordered body centered cubic (A2) crystal structure to CsCl(B2)-type crystal structure; and then (d) slowly cooling the alloy to a temperature in the range of from 450° C. to 550° C.;

(2) refining the micro-twinning of the alloy crystal structure by (a) cold working the alloy in the temperature range of from room temperature to less than 600° C.; and then (b) annealing the alloy in the temperature range of from 500° C. to less than 600° C.; and (3) orienting the micro-twins by (a) cooling the alloy to a temperature below the shape transition temperature range (TTR);

(b) placing a sufficient load on the alloy to cause a 5 to less than 8 percent strain in the alloy;

(c) heating the alloy while still under load to a temperature above the shape transition temperature range (TTR);

(d) cooling the alloy while still under load to a temperature below the shape transition temperature range (TTR);

(e) increasing the load back to the load applied in substep (3)(*b*);

(f) heating the alloy while still under load to a temperature above the shape transition temperature range; and (g) repeating substeps (3)(*d*), (3)(*e*), and (3)(*f*) until the desired degree of micro-twin orientation has been achieved.

BRIEF DESCRIPTION OF THE DRAWING

The FIGURE is a plot showing the added forces exerted by a TiNi-base (50 atomic % Ni, the rest Ti) memory alloy when strips of it were heated up through the shape transition temperature range (TTR). Data is provided for strips of various thickness both before and after treatment by the process of this invention. The FIGURE is discussed in the example.

DETAILED DESCRIPTION OF THE PREFERRED EMBODIMENTS

This invention is a process for maximizing the magnitude and the reproducibility of the memory shape change titanium-nickel base alloys. As is well known the TiNi phase of these alloys is responsible for the shape change memory effect. The present process (1) increases the amount of the TiNi phase with CsCl(B2) type crystal structure, (2) increases the micro-twin population of the TiNi phase, and (3) also improves the orientation of the micro-twins. Each of these three factors contribute to a greater, more reproducible memory shape change effect.

This process may be used to improve alloys which depend upon the TiNi phase for their shape memory effect. Included are titanium-nickel based shape change memory alloys to which minor amounts of other metals, such as cobalt, iron, nickel, aluminum, zirconium, chromium, and copper, have been added to modify the shape change memory transition temperature range. Examples of these alloys are disclosed in U.S. Pat. Nos. 3,594,239 and 4,144,057. Alloys composed of from 47 to 53 atomic weight percent of nickel with the remainder being titanium are preferred, with TiNi (50 atomic weight percent nickel, the remainder being titanium) being the most preferred.

The first step of the present process is to maximize the CsCl(B2)-type crystal structure in the TiNi phase. In substep (1)(*a*) the alloy is heated at a temperature above 700° C. but not more than 800° C. long enough to convert the TiNi phase into body centered cubic (A2) structure. For example, heating a titanium-nickel based alloy at 800° C. until the entire sample reaches this temperature will accomplish this. However, because $O_2$ diffuses quite rapidly in TiNi alloys (even oxide-coated alloys heated in controlled atmospheres) the temperature should not exceed 800° C. and the time-at-temperature should be as short as possible. Longer times are permissible when the alloy is heated in a controlled (i.e. dry, inert) atmosphere (e.g., dry helium or argon) after first removing any surface oxide coating. Next, in substep (1)(*b*), the alloy is slowly cooled (e.g., in a furnace) to a temperature in the range of from 600° C. to 700° C., and preferably from 625° C. to 675° C. The alloy is maintained at a temperature in this range until the TiNi phase has been substantially converted from the disordered body center cubic (A2) structure to CsCl(B2)-type crystal structure. For instance, in the example this was accomplished by heating a TiNi-based alloy at 650° C. for three hours. The alloy is then slowly cooled (e.g., in a furnace) to a temperature in the range of from 450° C. to 550° before the next process step. The relationship between crystal structure and temperature for TiNi-base alloys is summarized in table 1.

TABLE 1

| Temperature range | Alloy structure |
|---|---|
| Melting Point → 700° C. | Disordered Body Centered Cubic(A2) |
| 700° C. → ~ 600° C. | Atomic Ordering Range BCC(A2) → CsCl(B2) |
| 600° C. → Critical Transition Temp. Range (TTR) | CsCl(B2) |
| In the TTR | CsCl(B2) → P3ml |
| Below TTR | P3ml |

The second step of the process increases the micro-twins in the titanium-nickel base alloy by a combination of cold working and annealing. Substep (2)(*a*) consists of cold working the alloy at a temperature of from room temperature to less than 600° C. A preferred method is to either roll or swage the titanium-nickel alloy stock at a temperature of from 450° C. to 550° C. Another method is to allow the titanium-nickel alloy stock to cool to room temperature in still air and then use conventional methods of cold working, such as drawing, to process it. After the titanium-nickel alloy has been cold worked, it is annealed for a carefully selected time (based upon prior working, drawing, etc.) at a temperature of from 500° C. to 550° C. in substep (2)(*b*).

While some initial micro-twins may be brought about in the second step, the third step of the process is used to further increase the micro-twin density. In substep (3)(*a*) the TiNi based alloy is cooled to below the memory shape change transition temperature range (TTR). In substep (3)(*b*), a load is placed on the alloy which is sufficient to cause a 5 to less than 8 percent strain, preferably a 5 to 7 percent strain, and more preferably about a 6 percent strain, in the alloy. Then in substep (3)(*c*) the alloy is heated under load (the total load increases with heating by virtue of the heat-induced additive loading) to a temperature above the TTR but below 600° C. Next, in substep (3)(*d*) the alloy is cooled to a temperature below the TTR. At this point the load on the alloy sample will be lower than that originally applied in substep (3)(*b*). Substep (3)(*e*) comprises increasing the applied mechanical load back to the same numerical value as was applied in substep (3)(*b*). Thus, if a load of 350 lbs. had originally been applied to the alloy sample to produce a 6 percent strain, the load will be increase back up to 350 lbs. in substep (3)(*e*). Finally, in substep (3)(*f*) the alloy is again heated to a temperature above the shape transition temperature range (TTR). Substeps (3)(*d*), (3)(*e*), and (3)(*f*) are repeated until the desired degree of shape memory consistency has been achieved. This is indicated by both a leveling and maximizing of the total load (applied load plus heat-induced load). In the example below it was found that 6 cycles produced alloy samples with consistent shape change memory properties.

The general nature of the invention having been set forth, the following example is presented as a specific illustration thereof. It will be understood that the invention is not limited to this specific example but is susceptible to various modifications that will be recognized by anyone of ordinary skill in the art.

EXAMPLE

A TiNi-base alloy stock composed of approximately 50 atomic weight percent nickel and 50 atomic weight percent titanium was heated through at 800° C. The alloy stock was then furnace cooled slowly to 650° C. and held at 650° C. for three hours. The alloy stock was then furnace cooled slowly to 500° C. and then roll into strips at that temperature. The alloy was reheated in the 500° C. to less then 600° C. range to refine the micro-twinning. Care was taken not to wipe out the micro-twinning by heating the alloy too long in that temperature range. The resulting TiNi alloy strips had a shape transition temperature range (TTR) of from 70° C. to 80° C.

The following procedure was used to treat each of the TiNi strips. First the alloy strip was placed in a tensile tester in ice water (temperature below the TTR). The tensile tester was used to pull axially on the strip with sufficient force to cause a 6 percent strain to occur. The load required to cause this initial 6 percent strain was recorded. The strip, still under load, was then placed in boiling water (temperature above the TTR) and after the strip had heated through the resulting load was recorded.

The following three steps in order comprised a cycle which was then repeated 5 times for each sample:

(1) The strip, still under load, was cooled in ice water (below the TTR) and the resulting load recorded.

(2) The load was increased to the load which has been used to cause the initial 6 percent strain.

(3) The strip, still under load, was then heated in boiling water. After the strip had been heated through, the resulting load was recorded.

Table 2 provides typical data obtained for 4 samples.

TABLE 2

| Sample number | Initial Length (") | Load (lbs) (6% strain) | | Load (lbs) at each cycle Cold | Load (lbs) at each cycle Hot | Dimension after 6 cycles (inches) | Cold | Hot |
|---|---|---|---|---|---|---|---|---|
| D-4047 | 5.575 | 374 | (1) | 374 | 270 | length | 5.880 | 5.590 |
| #1 | | (0.335") | (2) | 108 | 366 | width | 0.364 | 0.374 |

TABLE 2-continued

| Sample number | Initial Length (") | Load (lbs) (6% strain) | | Load (lbs) at each cycle Cold | Hot | Dimension after 6 cycles (inches) | Cold | Hot |
|---|---|---|---|---|---|---|---|---|
| | | | (3) | 188 | 401 | thickness | 0.0298 | 0.0302 |
| | | | (4) | 231 | 425 | | | |
| | | | (5) | — | 434 | | | |
| | | | (6) | 270 | 446 | | | |
| D-4047 #2 | 5.575 | 387 (0.335) | (1) | 387 | 308 | length | 5.880 | 5.580 |
| | | | (2) | 120 | 416 | width | 0.363 | 0.374 |
| | | | (3) | 223 | 451 | thickness | 0.0296 | 0.0300 |
| | | | (4) | 270 | 469 | | | |
| | | | (5) | 278 | 473 | | | |
| | | | (6) | 281 | 475 | | | |
| D-4047 #3 | 6.015 | 353 (0.361) | (1) | 353 | 260 | length | 6.375 | 6.030 |
| | | | (2) | 50 | 344 | width | 0.363 | 0.374 |
| | | | (3) | 110 | 388 | thickness | 0.0287 | 0.0293 |
| | | | (4) | 162 | 418 | | | |
| | | | (5) | 208 | 442 | | | |
| | | | (6) | 214 | 453 | | | |
| D-4047 #4 | 6.005 | 345 (0.360) | (1) | 345 | 284 | length | 6.375 | 6.030 |
| | | | (2) | 68 | 365 | width | 0.363 | 0.375 |
| | | | (3) | 152 | 402 | thickness | 0.0287 | 0.0292 |
| | | | (4) | 194 | 425 | | | |
| | | | (5) | 226 | 436 | | | |
| | | | (6) | 237 | 445 | | | |

The FIGURE is a plot of Force versus thickness for a number of TiNi alloy strips having a composition of about 50 atomic percent nickel and about 50 atomic percent titanium. Open triangles represent forces below the TTR for untreated strips. Shaded triangles represent forces above the TTR for these untreated strips. Open circles represent forces below the TTR for these strips after they have been treated. Shaded circles represent forces above the TTR for the treated strips. Note that more than one set of points at a given thickness indicates that more than one sample was measured. For instance, two samples having a 0.016 inch and two samples having a 0.024 inch thickness were measured. Similarly, three samples having 0.028 inch thickness are recorded in the FIGURE.

The data plotted in the FIGURE illustrate the improved shape change memory properties which are achieved by this process. The difference in force between an unshaded point (below the TTR) and the corresponding shaded point (above the TTR) is the force which is produced when the strip is heated up through the TTR multipled by $10^{-2}$ (e.g., a reading of 1.5 on the abscissa represents 150 pounds of force). As can be seen, this force is greater after a strip has been treated (circles) than before treatment (triangles). As the thickness of treated strips is increased, the forces change in a predictable way. For untreated strips, however, the forces vary randomly. Finally, the improvement in reproducibility of shape change memory is illustrated by the close grouping of the circles (treated) as compared to the triangles (untreated). Note, for example, the data for the 0.016, 0.024, and 0.028 inch strips.

Obviously, many modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A process for improving the shape change memory properties of a titanium-nickel base alloy comprising the following steps in order:

(1) forming a favorable atomic-order in the alloy by
  (a) heating the alloy at a temperature in the range of from just above 700° C. to 800° C. until the TiNi phase has stabilized into disordered body centered cubic (A2) crystal structure;
  (b) slowly cooling the alloy to a temperature in the range of from 600° C. to 700° C.; and
  (c) annealing the alloy in the temperature range of from 600° C. to 700° C. until the TiNi phase has been substantially converted from disordered body centered cubic (A2) crystal structure to CsCl(B2)-type crystal structure; and then
  (d) slowly cooling the alloy to a temperature in the range of from 450° C. to 550° C.;

(2) refining the micro-twinning of the alloy crystal structure by
  (a) cold working the alloy in the temperature range of from room temperature to less than 600° C.; and then
  (b) annealing the alloy in the temperature range of from 500° C. to less than 600° C.; and (3) orienting the micro-twins by
  (a) cooling the alloy to a temperature below the shape transition temperature range;
  (b) placing a sufficient load on the alloy to cause from a 5 to less than 8 percent strain in the alloy;
  (c) heating the alloy while still under load to a temperature above the shape transition temperature range;
  (d) cooling the alloy while still under load to a temperature below the shape transition temperature range;
  (e) increasing the load back up to the load applied in substep (3)(*b*);
  (f) heating the alloy while still under load to a temperature above the shape transition temperature range; and
  (g) repeating substeps (3)(*d*), 3(*e*), and (3)(*f*) until the desired degree of micro-twin orientation has been achieved.

2. The process of claim 1 wherein in substep (1)(*a*) the alloy is heated at about 800° C. until all of the alloy reaches the temperature of about 800° C.

3. The process of claim 1 wherein in substep (1)(*c*) the alloy is heated at a temperature in the range of from 625° C. to 675° C. for at least 3 hours.

4. The process of claim 3 wherein in substep (1)(*c*) in the alloy is heated at a temperature of about 650° C.

5. The process of claim 1 wherein substep (2)(*a*) comprises rolling the alloy stock in the temperature range of from 450° C. to 550° C.

6. The process of claim 2 wherein substep (2)(*a*) comprises swagging the alloy stock in the temperature range of from 450° C. to 550° C.

7. The process of claim 1 wherein substep (2)(*a*) comprises allowing the alloy stock to cool in still air to room temperature and then cold working the alloy.

8. The process of claim 7 wherein the cold working is drawing.

9. The process of claim 2 wherein the load applied in substep (3)(*b*) is enough to cause a strain of from 5 to 7 percent.

10. The process of claim 9 wherein the load applied in substep (3)(*b*) is enough to cause about a 6 percent strain.

11. The process of claim 2 wherein substeps (3)(*d*), (3)(*e*), and (3)(*f*) are repeated at least 5 times.

12. The process of claim 2 wherein substeps (3)(*d*), (3)(*e*), and (3)(*f*) are repeated until the shape recovery has been maximized as indicated by the leveling off and maximizing of the total load (applied load plus heat induced load).

13. The alloy produced by the process of claim 1.
14. The alloy produced by the process of claim 2.
15. The alloy produced by the process of claim 3.
16. The alloy produced by the process of claim 4.
17. The alloy produced by the process of claim 5.
18. The alloy produced by the process of claim 6.
19. The alloy produced by the process of claim 7.
20. The alloy produced by the process of claim 8.
21. The alloy produced by the process of claim 9.
22. The alloy produced by the process of claim 10.
23. The alloy produced by the process of claim 11.
24. The alloy produced by the process of claim 12.

* * * * *